US005417181A

United States Patent [19]

Idstein et al.

[11] Patent Number: 5,417,181

[45] Date of Patent: May 23, 1995

[54] COATING DEVICE

[75] Inventors: Hermann Idstein, Oestrich-Winkel; Guenter Hultzsch, Wiesbaden; Dieter Toepfer, Heidenrod, all of Germany

[73] Assignee: Hoechst Aktiengesellschaft, Frankfurt am Main, Germany

[21] Appl. No.: 113,638

[22] Filed: Aug. 31, 1993

[30] Foreign Application Priority Data

Aug. 31, 1992 [DE] Germany ..... 42 28 991.2

[51] Int. Cl.[6] ..... B05C 5/00

[52] U.S. Cl. ..... 118/231; 118/252; 118/256; 118/409; 118/419

[58] Field of Search ..... 118/230, 231, 252, 256, 118/409, 410, 419

[56] References Cited

U.S. PATENT DOCUMENTS

| | | | |
|---|---|---|---|
| 2,681,294 | 6/1954 | Beguin | 118/126 |
| 3,187,718 | 6/1965 | Coghill | 118/126 |
| 3,707,942 | 1/1973 | Leri | 118/252 |
| 4,241,689 | 12/1980 | Kobayashi et al. | 118/50 |
| 4,283,443 | 8/1981 | Choinski | 427/295 |
| 4,400,953 | 8/1983 | Driessen et al. | 68/202 |
| 4,411,218 | 10/1983 | Wollam et al. | 118/411 |
| 4,545,321 | 10/1985 | Bassa | 118/50 |
| 5,112,653 | 5/1992 | Damrau et al. | 427/356 |
| 5,183,691 | 2/1993 | Hassell et al. | 427/286 |

FOREIGN PATENT DOCUMENTS

| | | |
|---|---|---|
| 0168986 | 6/1985 | European Pat. Off. . |
| 3309343 | 9/1984 | Germany . |

*Primary Examiner*—James C. Housel
*Assistant Examiner*—Long V. Le
*Attorney, Agent, or Firm*—Foley & Lardner

[57] ABSTRACT

A coating device bears against support roll via runners or guide members which are arranged on the two sides of the housing of the coating device. The coating device is displaceable along guides and is forced by a pressure force against the support roll. Each of the runners or guide members is finished with a reduced-friction coating and is preferably rotatably articulated via a pivot to the housing of the coating device.

20 Claims, 3 Drawing Sheets

Fig. 1
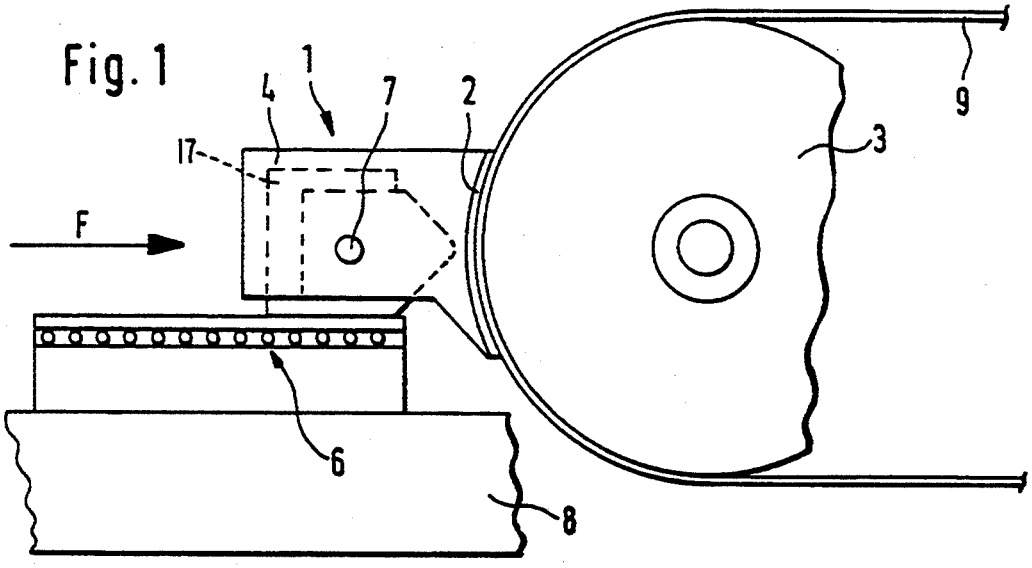
Fig. 2
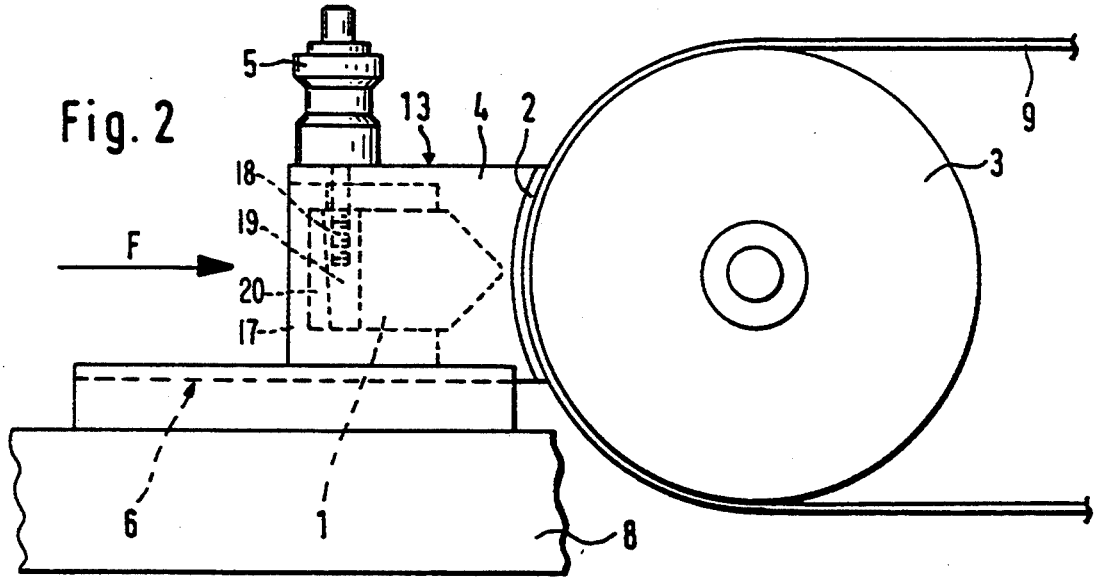
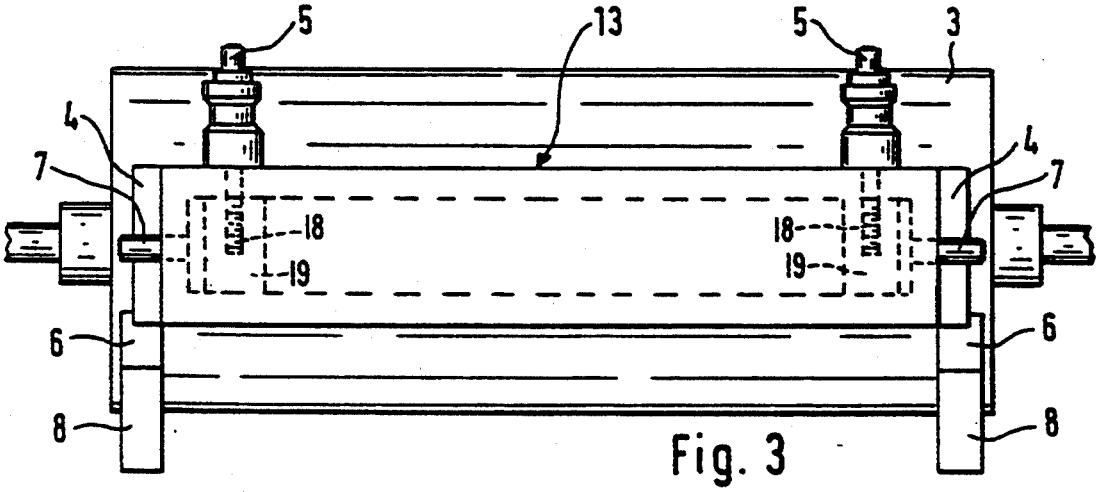
Fig. 3

Fig. 4
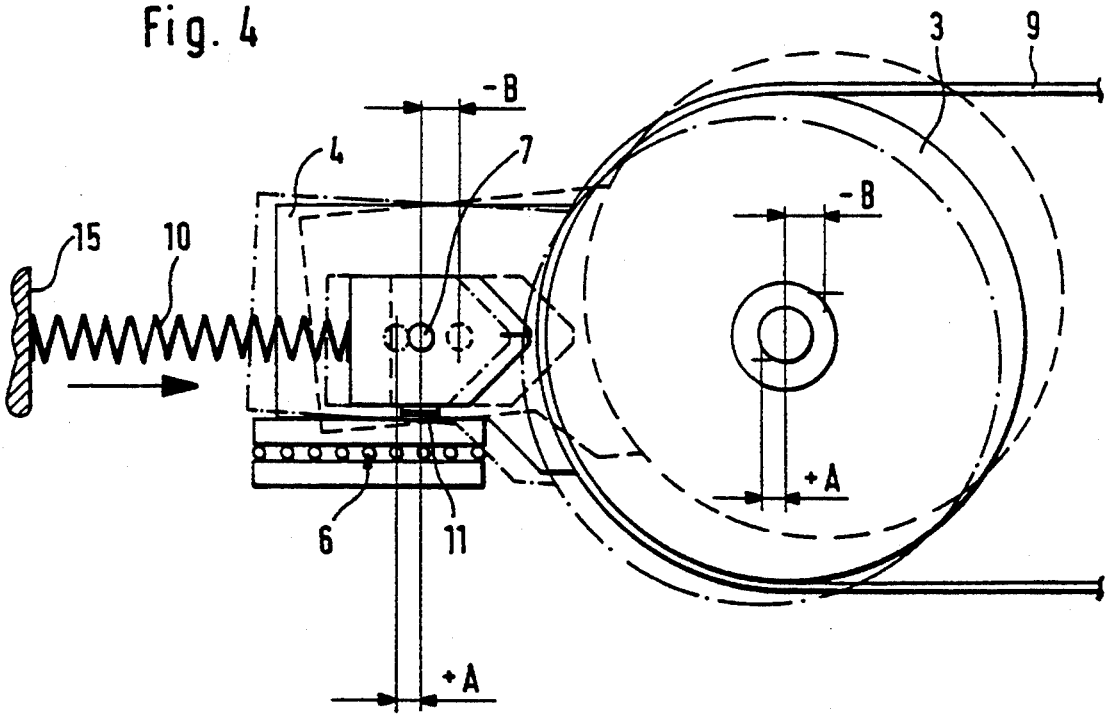
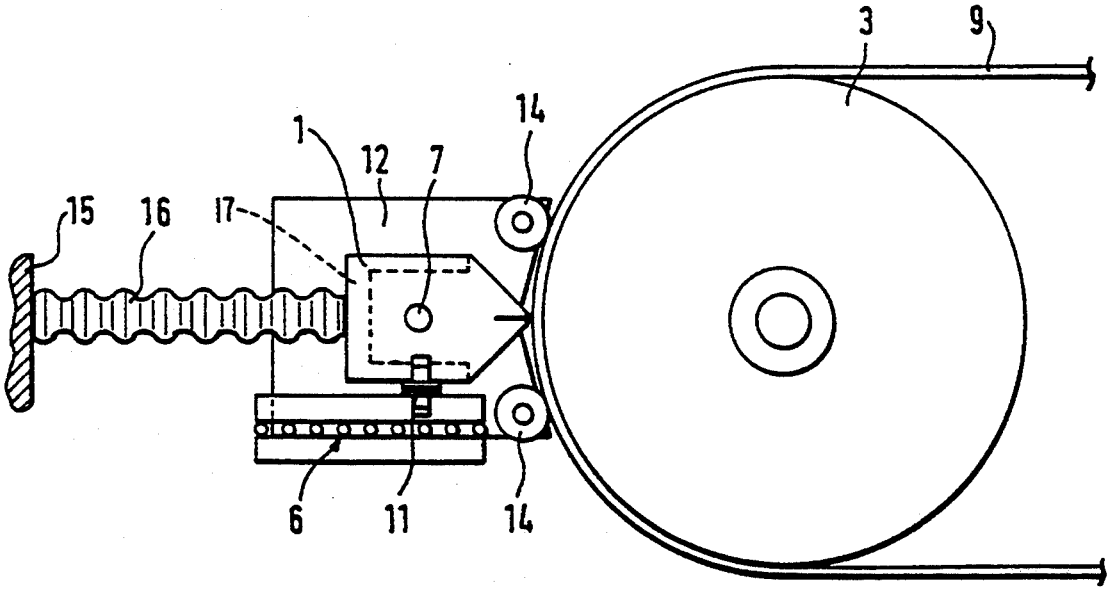
Fig. 5

COATING DEVICE

BACKGROUND OF THE INVENTION

The present invention relates to a coating device and more especially to a coating device having an applicator mechanism for applying a liquid layer to a sheet-type support material which is conducted over an applicator roll.

The development in coating technology leads to assemblies of ever higher performance, i.e., to higher processing speeds and to thinner coating films or more highly concentrated solutions of the coating agents, which is desirable above all for ecological and economic reasons.

These demands can be met only by a substantial increase in the precision of the interacting components, above all by maintaining a uniform coating gap between the applicator roll and applicator mechanism. For high coating speeds, smaller gap distances are required, and it is indispensable in this case to maintain precise distances. Radial deviations of the applicator roll cause periodic differences in layer thickness, which are undesirable in every case.

The mounting of the applicator roll in this context requires particular attention, since high accuracy of running in the axial and radial directions is obtained by well-designed mounting. The running accuracy is here defined as the deviation from the ideal axis of rotation, the deviation arising as the total error from all the interacting components on the applicator roll. The deviation of rolling bearings having a particularly high accuracy cannot be less than 3 μm from the ideal axis of rotation. This minimum theoretical radial deviation of such rolling bearings is increased by further individual errors of the applicator roll. During the rotation of the applicator roll, the errors of the left-hand side thereof can lead to a diminution of the distance between the applicator roll and the coating device, while at the same time an increase in the distance between the applicator roll and the coating device results on the right-hand side.

Furthermore, due to the traction forces of the sheet-type support material being coated, the inevitably-present bearing play leads to a misalignment of the applicator roll, whereby an enlargement of the gap results. Likewise, different traction forces on the right-hand and left-hand sides of the sheet-type support material can lead to tumbling of the applicator roll during operation of the coating device, whereby achievement of a constant distance between the applicator roll and the coating device is limited.

Further deteriorations are to be expected, for example, during prolonged operation of the coating device, due to temperature variations in the region of the applicator mechanism, or due to wear in the mounting of the applicator roll.

Known applicator systems for applying a coating to printing plates, manufactured by Hoechst AG, are mounted to be displaceable in parallel guides relative to the applicator roll. A change in the distance between the applicator roll and the application lip can be effected by means of stops, in order to apply different coating thicknesses to the support material. Great efforts are made here in the design, in order to achieve precise dimensions of the gap and to maintain the layer thickness across the entire width of the support material within very narrow tolerances in the μm range. The radial deviation of the applicator roll and the play of the mounting on both sides and the radial deviation thereof are decisive for the accuracy of the layer thickness. Even with a most careful selection of the bearings and precise machining of the applicator roll, in order to achieve a high truth of running, the set layer thickness cannot be kept constant due to varied material stresses, increases in the play of the bearings and temperature influences. This leads to products of lower quality, higher reject rates, increased testing costs or, due to exchange and reworking of the components concerned, to high down-time costs and fabrication costs.

The device, described in DE-A 3,309,343, for applying at least one coating layer to a moving, sheet-type substrate has a rotating applicator roll which guides the substrate. A curtain coater is arranged close to the applicator roll, separated only by a gap. The coating gap can be changed by adjusting the curtain coater with a radial component. The coater can also be adjusted in any other directions desired, in order to take account of the numerous factors which must be watched in operation, such as the material properties of the emulsion and overcoating solutions, the layer thickness on the sheet-type support material, the range of the coating speed, and the like. However, no precautions are taken to allow for non-uniformities of the layer thickness due to radial deviation of the applicator roll nor due to play in the mounting of the coater.

In European Patent EP-B 0,168,986, a sliding film coating at reduced pressure with tangential application of the coating solution is described. The sliding film flows down on a vertical wall and passes through a gap onto the sheet to be coated. At this point, the sheet is deflected over a roll in such a way that the coating film comes tangentially into contact with the sheet. The coating device is mounted to be rotatably adjustable about the axis of the coating roller, and the angle of the sliding track is adjusted within a range from 20° to 120° relative to the horizontal. For this purpose, the housing of the coating device is supported on each side by arms which are rotatable about the axis of the coating roller. The support arms allow the coating device to be arranged in any desired position along the periphery of the coating roller. Even in this known coating device, no precautions are taken to compensate radial deviations or mounting errors, which impair the constancy of the layer thickness on the support material which is to be coated.

SUMMARY OF THE INVENTION

It is therefore an object of the present invention to provide an improved coating device.

A further object of the invention is to provide a coating device that compensates for errors in the mounting of the applicator roll of a coating device, such as, for example, rolling bearing errors, due to eccentricities of the internal rings, shape errors and dimensional errors of the individual rolling bodies as well as bearing play, temperature variations and changes in the traction force of the sheet-type support material which is to be coated, and the resulting variations in layer thickness of the liquid layer applied to the support material.

In accomplishing these and other objects, there has been provided in accordance with the present invention a coating device for applying a liquid layer to a surface of a sheet-type support material, comprising a support roll for transporting the sheet-type support material; a base; an applicator mechanism mounted on the base and positioned in close proximity to the support roll for applying a liquid layer to the surface of the support material transported on the support roll; a guide member, attached to each lateral side of the applicator mechanism, each of the guide members being biased into bearing contact upon the outer surface of the support roll or the sheet-type support material transported thereon, the guide members tracking displacement of the support roller and adjusting alignment of the applicator mechanism with respect to the sheet-type support material transported on the support roll.

Further objects, features and advantages of the invention will become apparent to those skilled in the art from the detailed description of preferred embodiments that follows, when considered together with the attached figures of drawing.

BRIEF DESCRIPTION OF THE DRAWINGS

The invention is explained in more detail below by reference to preferred illustrative examples represented in the drawings, in which:

FIG. 1 shows a diagrammatic side view of a prestressed coating device with rotatably mounted runners and an applicator roll, according to a first embodiment of the invention;

FIG. 2 shows a diagrammatic side view of a prestressed coating device with rigidly mounted runners and an applicator roll, according to a second embodiment of the invention;

FIG. 3 shows a front view of the first embodiment according to FIG. 1;

FIG. 4 shows various positions of the coating device of the first embodiment according to FIG. 1 during the occurrence of bearing play and bearing errors of the applicator roll;

FIG. 5 shows a diagrammatic side view of a coating device with roller runners, according to a third embodiment of the invention.

DETAILED DESCRIPTION OF THE PREFERRED EMBODIMENTS

Figure 6:
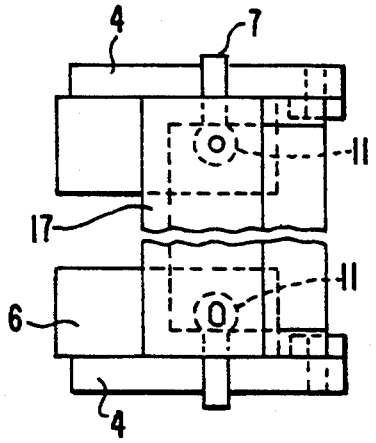
FIG. 6 is a top view of the device in FIG. 5, illustrating the configuration of the bearings.

In one embodiment of the invention, the two runners or guide members are rotatably articulated via pivots to the housing of the coating device. Each of the two runners is in this case finished, as a sliding runner, with a reduced friction coating.

In a further development of the invention, each runner or guide member is fitted, as a roller runner, with two rolls, and the rolls rest on the outer surface of the applicator roll.

Expediently, the runners bear against the outer surface of the applicator roll or against the edges (peripheral regions) of the sheet-type support material.

In a further embodiment of the invention, prestressed compression springs, whose ends bear against the rear of the coating device and against an abutment, exert the pressure force upon the coating device in order to force the runners thereof against the applicator roll or against the edges of the support material running over the applicator roll.

In place of compression springs, pneumatic elements can also exert pressure forces on the rear of the coating device and force the latter, via the runners thereof, against the applicator roll or against the edges of the support material running over the applicator roll. Expediently, the pneumatic elements are low-friction bellows cylinders. The coating device is adjustable along easily mobile, ball- or roll-mounted guides. Furthermore, the coating device is rotatably joined on both outer sides to the two guides via a bearing, in another preferred embodiment.

The invention achieves the advantage that a parallel and dimensionally accurate distance is ensured between the coating device for the application of a liquid layer to a moving sheet of support material and the applicator roll, over which the sheet of support material runs. By means of the runners or guide members, a constant gap between the coating device and the applicator roll is maintained, since all bearing errors and even non-uniform thicknesses of the support material are compensated by moving the prestressed coating device in or out, and the distance of the coating slot from the support material is thus kept constant even over prolonged operating periods.

Turning now to the drawings, the diagrammatic side view, shown in FIG. 1, of a pneumatically or spring-prestressed coating device 1 has, near to each of the two end faces of the coating device 1, a runner or pressure guide 4 which comprises a sliding runner or sliding pressure guide having a sliding, i.e., reduced friction, coating 2. The runners or pressure guides 4 bear against the outer surface of an applicator roll 3. A pressure force F is exerted from the rear of the coating device 1, such that the runners or pressure guides 4 are forced against the applicator roll 3 and prestressed. At the same time, the two runners or pressure guides 4 are supported on the opposing surface line or profile of the applicator roll 3. The coating device 1 can be fitted with a fine adjustment 5, as shown in FIG. 3, but it can also be without such a fine adjustment, as shown in FIG. 1.

The coating device 1 is, for example, a system with rolls running in the same or opposite directions, or a slot die or a sliding coater. The coating device 1 applies a liquid layer to a sheet-type support material 9, which forms the strip which is to be coated and which runs over the applicator roll 3.

The two runners or pressure guides 4, 4 are rotatably articulated via pivots 7, 7 to the housing 13 (cf. FIG. 3). When the applicator roll 3 rotates, the coating device 1 follows the relevant changes in the opposing surface line or profile of the applicator roll 3, this surface line at the same time being the line of contact between the runners or pressure guides 4, 4 and the applicator roll 3. Due to this arrangement, the distance between the applicator roll and the coating device 1 is kept constant, so that a coating gap, which is always parallel and true to dimensions, of the coating device 1 relative to the opposite generating line is ensured, and the total error from individual errors, such as bearing play, non-circularity of the applicator roll, radial deviation, shape errors of bearing and applicator roll 3, and oscillation and resilience of the applicator roll 3 in the case of different and changing traction forces in the sheet-type support material 9 which is to be coated, is corrected by the particular reactive movement of the coating device, and differences in layer thickness during coating are thereby largely avoided.

As a rule, the runners or pressure guides 4, 4 bear against the periphery of the applicator roll 3. However, it is also conceivable that, in the case of a smooth and abrasion-resistant support material which is being coated, the runners or pressure guides rest on the outer edge regions of the support material 9. As a result, it is also possible to additionally correct thickness differences in the sheet-type support material 9. Independently of whether the runners or pressure guides 4, 4 rest on the outer surface of the applicator roll 3 or on the outer edges of the sheet-type support material 9, they act in each case as spacers between the coating device 1, or the applicator mechanism of the coating device and the applicator roll 3.

The coating device 1 is moved along guides 6 which are arranged on both sides and are fixed to a base 8. This movement is preferably carried out to permit oscillation, but it can also be strictly linear. To permit oscillating movement, the coating device 1 is rotatably joined via a bearing on the two outer sides, as will be described in more detail below, to the two guides 6, so that the coating device 1 or the runners 4, 4 can not only execute a movement in the direction of the guides but also vertical oscillating movement in the longitudinal direction of the guides. If the bearing is omitted, the movement of the coating device is purely linear along the guides.

The second embodiment of the invention, diagrammatically shown in FIG. 2, is of a design similar to that of the first embodiment according to FIG. 1.

The coating device 1 is additionally fitted with a fine adjustment 5, so that the height of the applicator mechanism, i.e., of the slot die or of the sliding coater, can be adjusted very precisely, or the applicator mechanism can be moved in very small steps. The fine adjustment 5 includes a threaded spindle 18, which is engaged with corresponding threads of an adjustable vertical wedge 19. The wedge surface of wedge 19 slides along the wedge surface of a vertical counterwedge 20, so that the distance of the coating device from the applicator roll 3 can be precisely adjusted. The wedge 19, counterwedge 20, and slot die are all disposed within housing 17. It can be seen from FIG. 3 that each of the two guides 6 is seated on its own base 8. The same components as in the first embodiment according to FIG. 1 are marked in the second embodiment by the same reference numerals. Their description is not repeated. As the sliding coating 2 for the runners or pressure guides 4, for example, a slide bearing coating for dry running can be used. This can be provided with a solid lubricant film, for example grease, or it can be lubricated by drop lubrication with oil. Reduction in the frictional forces and cooling of the sliding runners can be achieved, in a manner not shown, by means of compressed air or water or else by cooling the applicator roll 3, particularly in the sliding zones of the runners.

In FIG. 4, various positions of the coating device 1 of the first embodiment of the invention according to FIG. 1 are illustrated in the case of bearing play and bearing errors of the applicator roll 3 occurring. The runners or pressure guides 4, 4 can follow the arising eccentricity of the applicator roll 3 and of the rotation thereof by means of vertical oscillating movements, as already mentioned above, about the guides 6, 6, whereby soft transitions between the maximum deviations of the axis of the applicator roll 3 from the ideal direction of the axis are ensured.

The spring force F acting on the housing of the coating device is exerted by prestressed compression springs 10, 10, one end of which bears against the rear of the coating device 1 and the other ends of which bear against abutments 15. The guides 6, 6 are easily movable, ball- or roll-mounted guides, along which the coating device 1 is displaceable or adjustable. The coating device 1 is rotatably joined on both outer sides to the two guides 6, 6 via bearings 11, it also being necessary to ensure that lateral play permits one-sided displacement of the coating device 1. For this purpose, one of the bearings 11 is located in an oblong hole 21 which extends transversely to the longitudinal direction of the guides 6. The prestress, acting on both sides, of the coating device 1 by the compression springs 10, 10 ensures continual reactive movement of the coating device against the applicator roll 3. In FIG. 4, the position of the coating device 1 and of the applicator roll 3, with ideal direction of the axis of the applicator roll, is shown in solid lines. Deviations of the axis of the applicator roll 3 from the ideal direction of the axis are indicated by +A and −B. The various positions of the applicator roll 3 relative to the coating device 1, when these deviations occur, are shown in dashed lines. To enable the coating device 1 always to follow the opposing surface or profile line of the applicator roll 3 in the case of rotation of the applicator roll 3 or in the case of deviations +A or −B occurring, the guides 6, 6 and the bearings 11, 11 ensure an easy-running arrangement for the movement of the coating device 1 in the direction +A or −B.

In FIG. 5, a third embodiment of the invention is shown diagrammatically, in which, in place of sliding runners or pressure guides, so-called roller runners 12 are employed, each of which is fitted with two rollers 14, 14, which bear in pairs against two opposing surface or profile lines of the applicator roll 3 or against the outer edges of the support material 9 running over the applicator roll 3. The roller runners 12 are, like the runners 4, rotatably articulated via pivots 7 to the housing of the coating device 1. The pressure force F is exerted, in this third embodiment, for example by two pneumatic elements 16 in place of the compression springs. These pneumatic elements 16 are, for example, low-friction bellows cylinders which are supported on one side by the abutment 15 and on the other side against the rear of the housing of the coating device 1. It is self-evident that such pneumatic elements 16 and likewise roller runners 12 can be used in place of the compression springs 10 or of the runners 4 in the first and second embodiments of the invention.

Very small total errors of one of the two rollers 14, 14 are, in the case of the roller runners 12, 12, reduced to half the amount via the pivot point, i.e., via the pivot 7. The contact pressure by the pneumatic elements 16, 16 should act as directly as possible against the coating device 1 upon the opposing surface or profile line of the applicator roll 3, in order to eliminate any play between the coating device 1 and the pivots 7 of the roll runners 12.

What is claimed is:

1. A coating device for applying a liquid layer to a surface of a sheet-type support material, comprising:

(a) a housing on which a pressure force is exerted from a side of said housing opposite said surface of the sheet-type support material;

(b) a support roll for transporting the sheet-type support material;

(c) a base;

(d) an applicator mechanism mounted on said base, disposed within said housing and positioned in close proximity to the support roll for applying a liquid layer to the surface of the sheet-type support material transported on the support roll;

(e) a movable, ball- or roll-mounted guide along which said applicator mechanism is adjustable or displaceable; and (f) a guide member, attached to each lateral side of said applicator mechanism, each of said guide members being biased into beating contact upon an outer surface of said support roll or upon the sheet-type support material transported thereon, said guide members tracking displacement of said support roll and adjusting alignment of said applicator mechanism with respect to said sheet-type support material transported on said support roll.

2. A coating device as claimed in claim 1, wherein said guide members are rotatably articulated via pivots to said housing.

3. A coating device as claimed in claim 1, wherein each of said guide members comprises a sliding runner having a reduced-friction coating on its surface facing said support roll.

4. A coating device as claimed in claim 1, wherein each of said guide members comprises a roller runner having two rollers resting on the outer surface of the support roll.

5. A coating device as claimed in claim 1, wherein said guide members bear against edge regions of the sheet-type support material transported on said support roll.

6. A coating device as claimed in claim 1, including prestressed compression springs having first ends bearing against said applicator mechanism on a side of said application mechanism opposite to said support roll, and second ends bearing against an abutment, to exert said pressure force upon said housing in order to bias said guide members against the support roll or against a surface of the sheet-type support material transported on said support roll.

7. A coating device as claimed in claim 1, including pneumatic elements having first ends bearing against said applicator mechanism on a side of said application mechanism opposite to said support roll, and second ends bearing against an abutment, to exert said pressure force upon said housing in order to bias said guide members against the support roll or against a surface of the support material transported on said support roll.

8. A coating device as claimed in claim 7, wherein said pneumatic elements comprise low-friction bellows cylinders.

9. A coating device as claimed in claim 1, further comprising on each lateral side of said applicator mechanism a bearing for rotatably joining said application mechanism to said guides.

10. A coating device as claimed in claim 1, further comprising fine adjustment means for adjusting the position of said applicator mechanism with respect to said base.

11. A coating device as claimed in claim 1, wherein said applicator mechanism comprises a slot die.

12. A coating device for applying a liquid layer to a surface of a sheet-type support material, comprising:

(a) a housing on which a pressure force is exerted from a side of said housing opposite said surface of the sheet-type support material;

(b) a support roll for transporting the sheet-type support material;

(c) a base;

(d) an applicator mechanism mounted on said base, disposed within said housing and positioned in close proximity to the support roll for applying a liquid layer to the surface of the sheet-type support material transported on the support roll;

(e) a movable, ball- or roll-mounted guide along which said application mechanism is adjustable or displaceable; and (f) a guide member, attached to each lateral side of said applicator mechanism, each of said guide members being biased into bearing contact upon an outer surface of said support roll or upon the sheet-type support material transported thereon, said guide members tracking displacement of said support roll and adjusting alignment of said applicator mechanism with respect to said sheet-type support material transported on said support roll, wherein said guide members are rotatably articulated via pivots to said housing and wherein each of said guide members comprises a sliding runner having a reduced-friction coating on its surface facing said support roll.

13. A coating device as claimed in claim 12, wherein each of said guide members comprises a roller runner having two rollers resting on the outer surface of the support roll.

14. A coating device as claimed in claim 12, wherein said guide members bear against edge regions of the sheet-type support material transported on said support roll.

15. A coating device as claimed in claim 12, including prestressed compression springs having first ends bearing against said applicator mechanism on a side of said application mechanism opposite to said support roll, and second ends bearing against an abutment, to exert said pressure force upon said housing in order to bias said guide members against the support roll or against a surface of the sheet-type support material transported on said support roll.

16. A coating device as claimed in claim 12, including pneumatic elements having first ends bearing against said applicator mechanism on a side of said application mechanism opposite to said support roll, and second ends bearing against an abutment, to exert said pressure force upon said housing in order to bias said guide members against the support roll or against a surface of the support material transported on said support roll.

17. A coating device as claimed in claim 16, wherein said pneumatic elements comprise low-friction bellows cylinders.

18. A coating device as claimed in claim 12, further comprising on each lateral side of said applicator mechanism a bearing for rotatably joining said applicator mechanism to said guides.

19. A coating device as claimed in claim 12, further comprising fine adjustment means for adjusting the position of said applicator mechanism with respect to said base.

20. A coating device as claimed in claim 12, wherein said applicator mechanism comprises a slot die.

* * * * *